United States Patent [19]

Gounder et al.

[11] Patent Number: 4,635,071

[45] Date of Patent: Jan. 6, 1987

[54] ELECTROMAGNETIC RADIATION REFLECTOR STRUCTURE

[75] Inventors: Raj N. Gounder, West Windsor; Chi-Fan Shu, Cranbury; Brian D. Jacobs, South Orange, all of N.J.

[73] Assignee: RCA Corporation, Princeton, N.J.

[21] Appl. No.: 521,913

[22] Filed: Aug. 10, 1983

[51] Int. Cl.[4] ..... H01Q 15/16

[52] U.S. Cl. ..... 343/897; 343/912

[58] Field of Search ..... 343/912, 915, 840, 897

[56] References Cited

U.S. PATENT DOCUMENTS

| | | | |
|---|---|---|---|
| 2,682,491 | 6/1954 | Hahn | 154/110 |
| 2,742,387 | 4/1956 | Giuliani | 154/110 |
| 3,029,433 | 4/1962 | Sokol | 343/912 |
| 3,096,519 | 7/1963 | Martin | 343/756 |
| 3,119,109 | 1/1964 | Miller et al. | 343/912 |
| 3,483,614 | 12/1969 | Kazimi | 29/600 |
| 3,716,869 | 2/1973 | Gould, Jr. et al. | 343/912 |
| 4,378,560 | 3/1983 | Khorsand | 343/912 |
| 4,394,529 | 7/1963 | Gounder | 136/245 |

FOREIGN PATENT DOCUMENTS

| | | | |
|---|---|---|---|
| 199303 | 12/1982 | Japan | 343/912 |
| 1544815 | 4/1979 | United Kingdom . | |

OTHER PUBLICATIONS

"Optimized Design and Fabrication Processes for Advanced Composite Spacecraft Structures," by Mazzio et al., 17th Aerospace Sciences Meeting, New Orleans, LA, Jan. 15–17, 1979, p. 2, col. 2, pp. 5–7.

"Advanced Composite Structures for Satellite Systems," by Gounder, RCA Engineer, 26–4, Jan./Feb. 1981, pp. 1, 14–18, 21.

"The SBS Communication Satellite–An Integrated Design," by Rosen, CH1352–4/78/0000–0343, 1978 IEEE, pp. 344–345.

"New Flexible Substrates with Anti–Charging Layers for Advanced Light–Weight Solar Array," by Rüsch, Proc. European Symp. on Photovoltaic Generators in Space, Sep. 11–13, 1978, sections 2–4.

*Primary Examiner*—Eli Lieberman
*Assistant Examiner*—Michael C. Wimer
*Attorney, Agent, or Firm*—Joseph S. Tripoli; Robert L. Troike; William Squire

[57] ABSTRACT

A deployable spacecraft borne circular reflector structure comprises a plurality of plies of graphite fiber reinforced epoxy (GFRE) fibers, each ply comprising at least two layers of graphite epoxy reinforced fibers having quasi-isotropic properties. A circular ring of multiple layer plies of like construction as the reflector and having a U-shaped cross-section is bonded to the reflector rear surface adjacent the reflector peripheral edge. Each layer of each structure is formed from prepreg graphite fiber epoxy reinforced material.

11 Claims, 12 Drawing Figures

ELECTROMAGNETIC RADIATION REFLECTOR STRUCTURE

This invention relates to structures for reflecting electromagnetic radiation and more particularly, for use in antennas.

Antenna reflectors are widely employed on earth orbiting satellites to facilitate directional receiving and beaming signals to earth. The environment of space can be harsh for such structures and the distortions of the reflectors due to temperature distributions, radiation environments, and other space related disturbances are of great concern. Certain reflectors are structurally fixed in place close to the support spacecraft and in such cases thermal distortions due to temperature distributions can be minimized by appropriate reflector support structure. These reflectors are often in the shadow of the main spacecraft body. The temperature distributions on large deployable reflectors (those which are stored in one position during launch of a spacecraft and deployed to an operating position substantial distances away from the main spacecraft after the spacecraft is in its operating orbit), are severe because the large deployable reflector is fully exposed to the sun and is thermally decoupled from the rest of the spacecraft to a greater degree than the fixed and close to spacecraft reflectors. The resulting thermal distortions of deployable reflectors can be serious and need to be dealt with. One solution proposed is to reduce the effect of distortion by the use of active devices which point the reflectors within specified tolerances when the reflectors are misaimed due to thermal distortion. However, such active devices lead to added weight, power consumption, and additional failure modes.

Thermal distortions become an important factor as the size of the reflector and/or the frequency of the electromagnetic radiation is increased. Present reflector design configurations for communications between a satellite and an earth station utilize relatively small diameter reflectors on the satellite and correspondingly large reflectors at the earth station. In a new class of communication satellites known as the Direct Broadcast Satellites (DBS), it is proposed that larger reflector structures radiating more power be used in the orbiting satellites for beaming much stronger signals to earth stations which may comprise reflectors having relatively small dimensions of, one or two meter diameters. These relatively larger satellite reflectors are exposed to thermal and other distortions in space which become more significant due to the increased dimensions of the DBS reflector structure. Also, reflector structures of present design, while adequate with respect to weight and distortion characteristics in the smaller dimensions, become increasingly burdensome and detrimental when the reflector dimensions are increased to the size for DBS use. Further complicating the situation is that DBS type reflectors are used in a deployed mode. In this case, thermal and other distortions become intolerable in present design configurations.

Reflectors in presently designed satellite communication systems generally employ advanced composite structures. These structures employ a cellular core, usually a honeycomb material which may be aluminum or a non-metallic fabric such as epoxy reinforced fibers. Skins formed of fabrics of advanced materials such as Kevlar/epoxy, graphite/epoxy and others cover the core material. (Kevlar is a registered trademark of the DuPont Corporation for an organic polyaramide fiber.)

By way of further example, an article entitled "Advanced Composite Structures for Satellite Systems," *RCA Engineer*, 26-4, Jan./Feb. 1981, by R. N. Gounder describes in more detail advanced composite materials including those mentioned above and others including boron and filamentary glass, that are employed in various spacecraft applications including reflector structures. On pages 15–17 is described an advanced composite structure employed in an overlapping polarized antenna reflector. This reflector structure uses a Kevlar-/epoxy sandwich parabolic antenna reflector design in a satellite system. In that structure the reflecting surfaces comprise first and second grids of parallel copper wires arranged orthogonally to each other. The structure supporting the reflecting grid elements are transparent to RF signals, such as Kevlar/epoxy material having low loss dielectric characteristics. These reflector structures employ honeycomb supporting structure between Kevlar skins which provide structural strength to the reflector.

In an article entitled "Optimized Design and Fabrication Processes for Advanced Composite Spacecraft Structures," by Mazzio et al., *17th Aerospace Sciences Meeting*, New Orleans, La., Jan. 15–17, 1979, composite antenna structures are described in detail on pages 5 and 6. A composite sandwich antenna is described which includes a graphite fiber reinforced epoxy faced aluminum honeycomb core sandwich reflector.

All of these latest advanced composite structures, while advantageous for the smaller dimensioned fixed in place reflector systems described above, become more unuseable with respect to the deployed larger dimensioned DBS reflecting systems which present insurmountable thermal and other distortions as well as added undesirable weight.

Although the reflector designs described in the RCA Engineer article and Mazzio's paper use sandwich skins of low coefficient of thermal expansion composite laminates, the adhesive and honeycomb contained in the sandwich construction have very large coefficient of thermal expansion and/or thickness. These combined with the possible temperature gradient through the sandwich thickness adversely affect the thermal distortion characteristics of the sandwich reflectors and also add to the complexity of the analysis method. Further, the designs described in the RCA Engineer article contain electromagnetic copper grids or sheets bonded to the reflecting surface. These materials have inherently large coefficient of thermal expansions and result in structural anisotropy and non-symmetry. The combined effect of all these materials is adverse thermal distortions and hence makes these designs unsuitable for high performance, high frequency DBS applications.

According to the present invention, an electromagnetic radiation reflector structure comprises a sheet of laminated material shaped to form an electromagnetic radiation reflector, the sheet being a section of a surface of revolution. A peripheral stiffening rib of laminated material is attached at a surface of and extending about the periphery of the sheet. The sheet and rib each comprise a laminated material including a plurality of plies where each ply includes a plurality of layers of graphite fiber reinforced epoxy (GFRE). The fibers in at least two adjacent layers are oriented relative to each other to form a quasi-isotropic ply. The quasi-isotropic plies are combined to have a plane of symmetry within the laminated sheet and rib.

Figure 1:
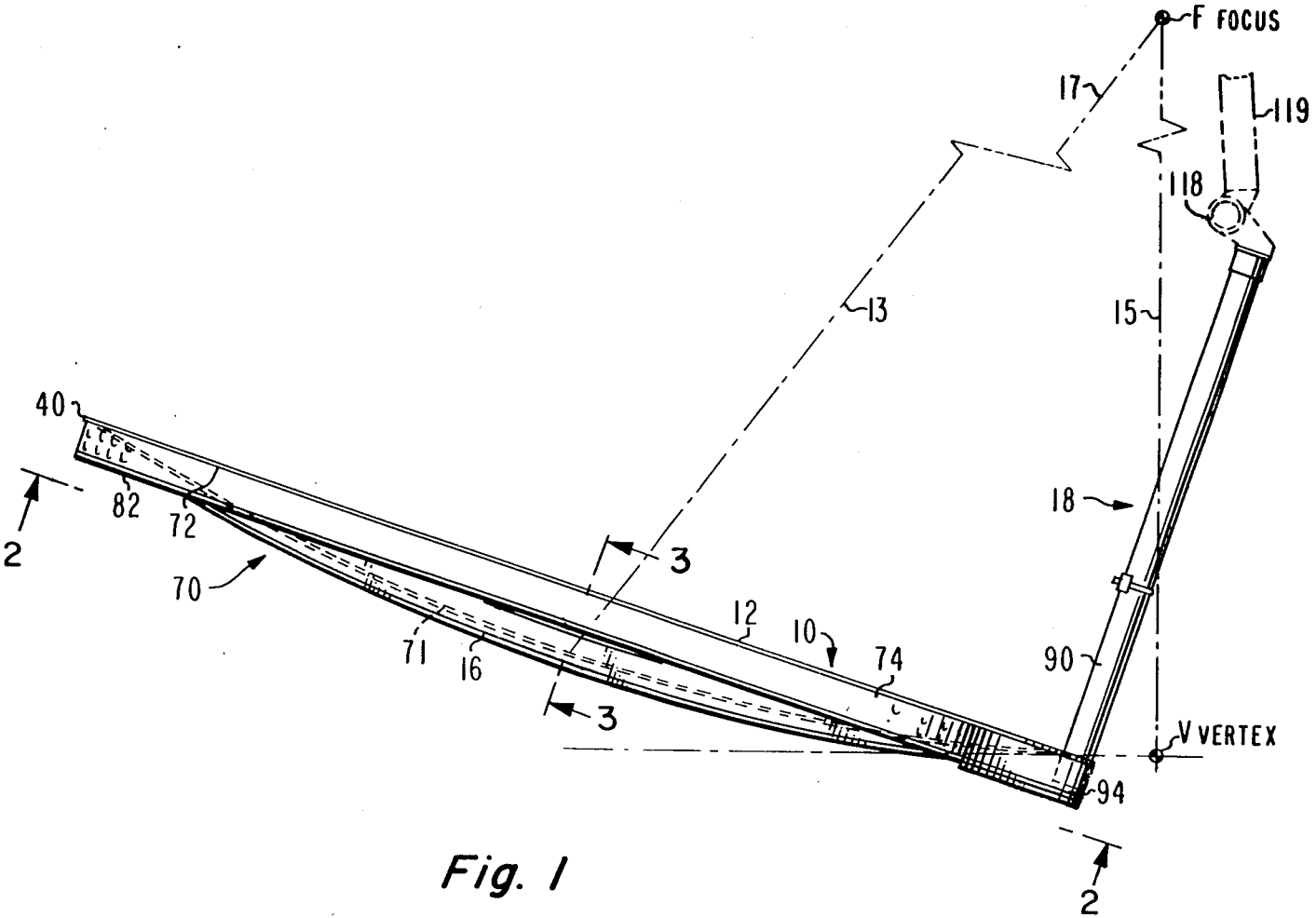
FIG. 1 is a side elevation view of an electromagnetic reflector structure in accordance with one embodiment of the present invention.
Figure 2:
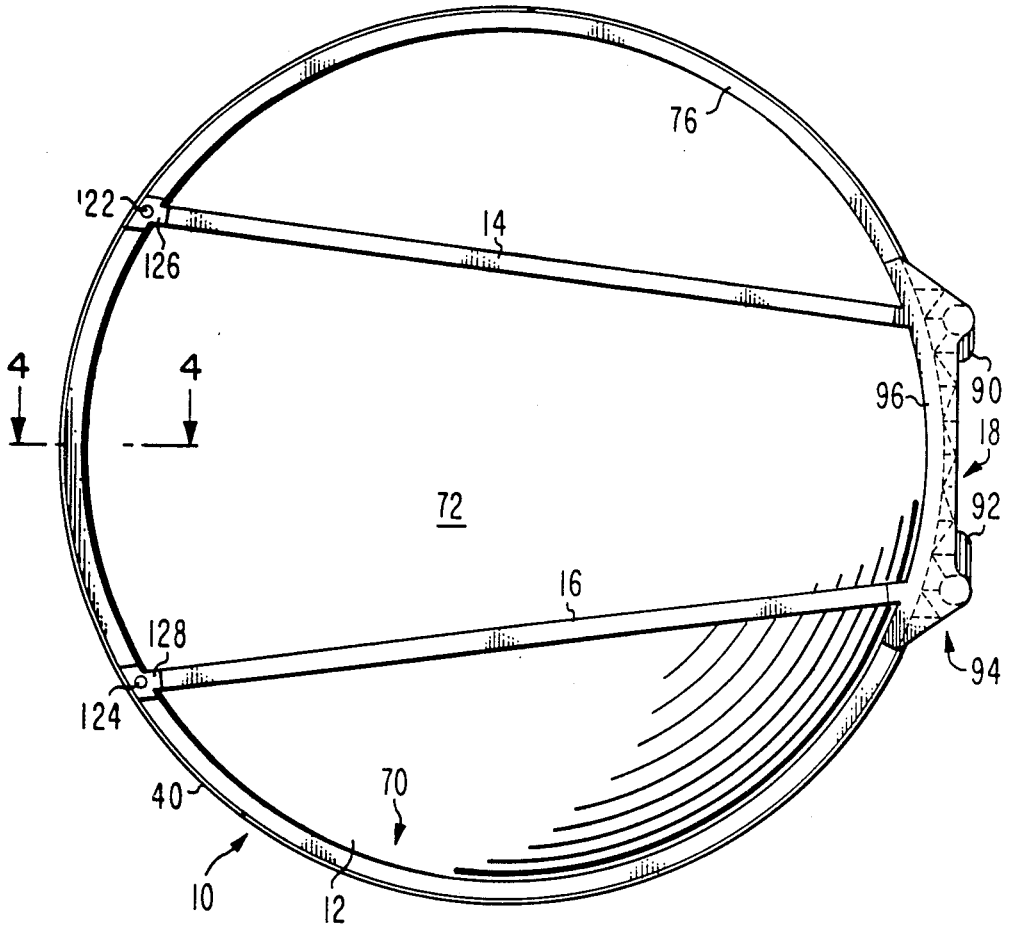
FIG. 2 is a bottom plan view of the reflector structure of FIG. 1 taken along lines 2—2.
Figure 3:
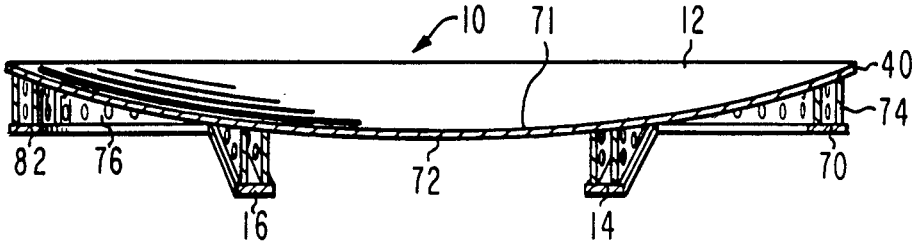
FIG. 3 is a sectional elevation view through the structure of FIG. 1 taken along lines 3—3.

In FIGS. 1 and 2 an electromagnetic radiation reflector structure 10 comprises a parabolic reflector sheet 12, a circular stiffening rib 70 secured to a rear surface 72 of the reflector sheet 12, a pair of transverse stiffening ribs 14, 16 secured to the rear surface 72 of reflector sheet 12 and to the inner wall 76 of the annular rib 70, and a supporting boom structure 18. The sheet 12 is in the form of a section of a paraboloid offset slightly from the vertex V. The antenna feeds would be located at the focus F. The broken line 13 represents the focal line to focus F. The focus is much further from sheet 12 than shown. The focus F would lie on line 13 if line 13 were extended until it intersected the line 15 from the vertex V. The line 13 is jogged at 17 to represent the extended length. The reflector sheet may be a section of any surface of revolution, for example, ellipsoid, spheroid, hyperboloid, and so forth. The reflector sheet 12, ribs 70, 14, and 16, and boom structure 18 all comprise, in one embodiment, multiple layers of unidirectional graphite fiber reinforced epoxy (GFRE) which will be described below. Unlike prior art reflectors employing cellular structures to provide structural support for the reflector, the present sheet 12 comprises a solid structure of multiple plies of unidirectional graphite epoxy reinforced fibers. This structure which can be relatively thin, for example, 0.018 mils thick without the ribs, is of extremely high strength and high stiffness, as will be described in more detail below, and experiences low thermal distortions in the presence of temperature variations and has quasi-isotropic properties.

Figure 9:
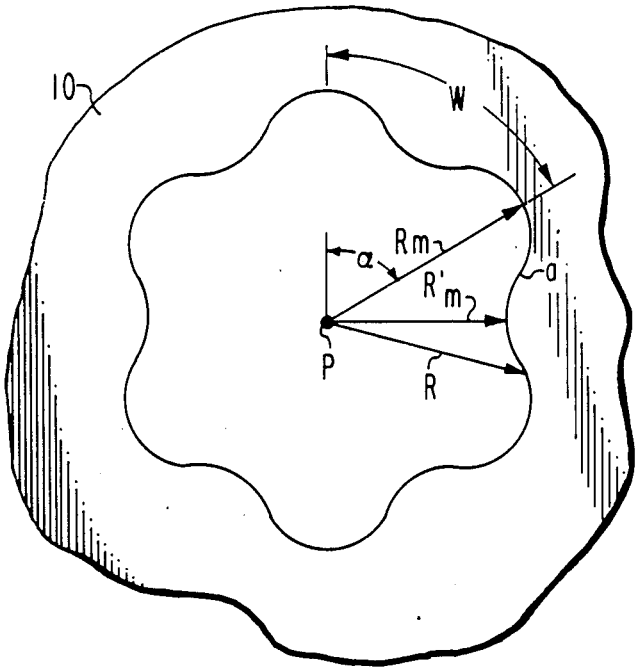
FIG. 9 is a graph useful in explaining some of the principles of the present invention.

By "quasi-isotropic" is meant the following. In FIG. 9 if a given point P on the reflector sheet 12 were examined with respect to various structural properties including, for example, coefficient of thermal expansion (CTE), Youngs modulus (hereinafter modulus) or other structural parameters, the parameters would vary in amplitude relative to point P as shown by the curve a. The radial dimension R represents the magnitude of a given parameter. As a parameter of the sheet 12 is examined in a 360° arc about the point P, it is seen that the curve a dimension R varies from a maximum $R_m$ to a minimum $R'_m$. The period W or wavelength of the peak-to-peak variations of the radial line R is no greater than 60°. If the variable parameter represented by the radial line R has a peak-to-peak variation of no greater than 60°, then the material is said to be quasi-isotropic. The actual variation in amplitude of the parameter from $R_m$ to $R'_m$ is not considered in determining whether the material is quasi-isotropic. Of course, an isotropic material would have a constant R and curve a would be a circle. In case of the coefficient of thermal expansion, the amplitude R and hence the variation in R are very nearly zero for a quasi-isotropic laminate as described above.

All of the materials forming the structure of the present invention, FIGS. 1 and 2, are quasi-isotropic. All of the materials are made of graphite fibers impregnated with an epoxy resin and commercially available in the form of tapes or broadgoods. The epoxy resin is tacky at room temperature and, therefore, forms an adhesive for bonding the lamination layers to one another, as will be described. By "broadgoods" is meant fabric in which the fibers are oriented at 90° relative to each other. The fibers in the tapes are unidirectional, that is, all of the fibers are parallel. The fibers in the broadgoods are woven into fabrics. Preferably, at least 50% of a tape structure comprises fiber material. A length of fiber in the tape is referred to as a "tow." The preimpregnated fibers at room temperature are referred to as "prepreg" material. The graphite fibers in the tape have a Youngs modulus of greater than 75 million pounds per square inch. Preferably the tape consists of continuous pitch filaments laid parallel and coplanar and assembled in the structure of FIGS. 1 and 2 in a semi-cured, that is, tacky state. The tapes are strips of the prepreg material which are commercially available in rolls, have relatively narrow widths and are relatively long, as will be explained below. The layers of prepreg material in the roll are separated by nonadherent sheet material.

After curing at an elevated temperature and pressure the prepreg tape or woven fabric hardens into a rigid hard layer having high strength properties. The impregnating resin should be relatively free of foreign materials and is noncorrosive to metals as well as capable of being molded at low pressure, for example, 15 to 100 psi.

The filaments, that is, the graphite fibers, are parallel and should not cross over, be wrinkled, or otherwise distored. A wrinkle is a portion of the material which is non-coplanar with the remainder of the tape. Separation between adjacent tows should be uniform and of minimum value. A discontinuous tow or other damage in a large number of fibers is also not desirable. However, tows may be spliced. By way of example, a prepreg tape employed in the present structure has a width dimension of 3 inches wherein sheet 12 has a diameter of about 85 inches. The fiber tows should be parallel to the two edges of the tape although minor variations within the plane of the tape is acceptable.

Figure 6:
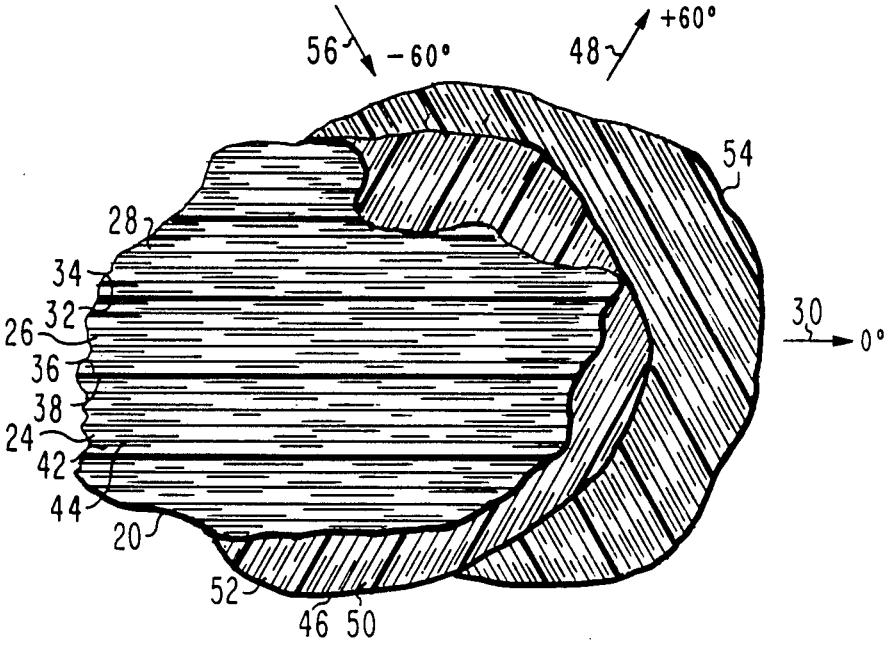
FIG. 6 is a plan view of a portion of the reflector structure of FIG. 1 illustrating the different layers of a single ply.

Reflector structure 10 of FIGS. 1 and 2 is constructed as follows. The reflector sheet 12 comprises, by way of example, a minimum of two plies of graphite fiber reinforced epoxy (GFRE) tapes. Woven fabrics may be used, as will be described. Each ply comprises three layers of GFRE fibers as shown in FIG. 6. In FIG. 6 a first layer 20 of ply 22 comprises a plurality of tapes 24, 26, 28, and so on having a fiber orientation in the zero degree direction 30.

Edge 32 of tape 28 abuts edge 34 of tape 26. The other edge 38 of tape 26 abuts edge 36 of tape 24. The remaining portion of layer 20 is similarly constructed of tapes with their edges abutting to form a single sheet of abutting tapes of GFRE fibers having the thickness of a tape. The tapes each extend completely across the reflector sheet 12 from one end of periphery 40 to the opposite edge, FIGS. 1 and 2. If the tapes 24, 26, 28, and so on of the layer 20 would lie flat rather than lie in a parabola, all of the fibers, for example, fibers 42, 44 would lie parallel. By placing narrow tapes 24, 26, 28, and so on of layer 20 so the edges abut each other without overlap, the fibers such as fibers 42 and 44, remain substantially equally spaced from each other throughout the length of a tape on the reflector even though they lie on a parabola.

The width of the tapes is important. Ideally, all fibers in a tape should lie parallel. Once the tape is bent to conform to a section of a surface of revolution, the fibers may shift from the parallel orientation. The maximum desired fiber shift is the tolerance for a given design implementation. For example, the tolerance might be 0.1 degree for adjacent fibers in one implementation. The width of a tape is a function of that tolerance and the focal length of the surface of revolution (or the flatness of the surface). The flatter the surface, the wider the tape. In the case of a paraboloid (and some other surfaces of revolution), the focal length and tolerance are proportional to the tape width: the smaller the tolerance or focal length, the narrower the width, the larger the focal length, the flatter the surface. In the example given previously, the three inch tape width corresponds to a paraboloid focal length of 85 inches. Once a focal length and tolerance are given, then the tape width can be calculated.

With respect to broadgoods fabrics. These are not laid up in strips as are the tapes. Such strips would present discontinuities in the fibers at the strip edges. The discontinuities would affect the reflecting performance of the reflector. Instead, these broadgoods fabrics are cut in a gore pattern, i.e., triangular sections in a known way.

A tacky second layer 46 in the prepreg state, FIG. 6, is adherently secured at room temperature to the tacky layer 20 also in the prepreg state. While the layers may be bonded with or without an adhesive layer (not shown) between adjacent tape layers, the tacky resins serve as the adhesive thus precluding the need for an additional adhesive layer. In one embodiment fibers of layer 46 are oriented in a direction +60°, direction 48, relative to direction 30. Layer 46 of ply 22 comprises a plurality of tapes constructed similarly as layer 20. That is, all of the narrow tapes, such as tapes 50, 52, and so on of layer 46 abut each other at their respective edges to form a single sheet of graphite fiber reinforced epoxy. Layer 46 being tacky at room temperature is adherently secured to layer 20. A third layer 54 of ply 22, also tacky and at room temperature, is secured to layer 46. Layer 54 has its fiber orientation 56 oriented at −60° relative to the reference direction 30 in this embodiment. the construction of the layers 20, 46, and 54 is referred to as [0°/±60°]. It can be shown that ply 22 formed by these three layers is quasi-isotropic, as explained above.

Figure 7A:
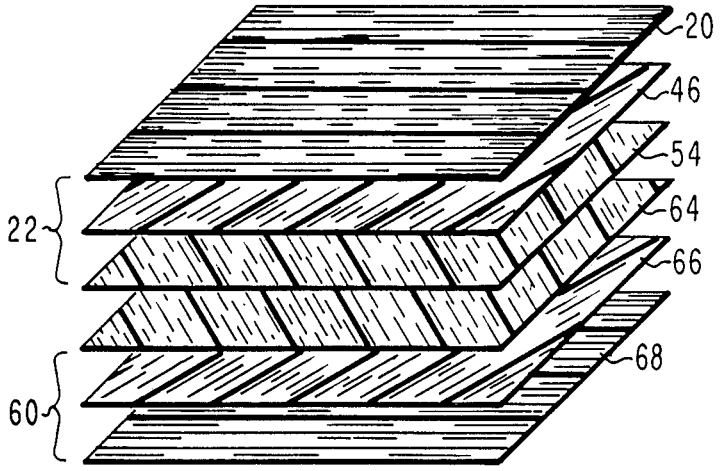
FIGS. 7A and 7B are isometric schematic representations of multiple plies employed in different embodiments in the structure of FIG. 1.
Figure 8:
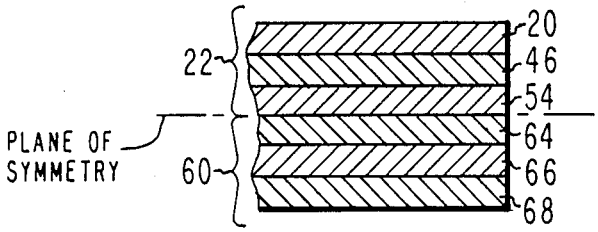
FIG. 8 is a sectional view through the reflector structure of FIG. 1.

In one embodiment the reflector structure 10 comprises two piles identical to ply 22, all layers being assembled in the tacky state at room temperature. After assembly, the laminate is cured at an elevated temperature in a known way at which time the materials harden, bond to each other, and lose their tacky characteristics. The zero degree reference orientation for each of the two plies is the same as direction 30, FIG. 6. Therefore, each of the two plies has three layers, one layer having its fibers in the reference direction 30, one layer having its fibers in the direction 48 (+60°), and one layer having its fibers in the direction 56 (−60°). These two plies are laid up such as to result in a symmetric laminate. A symmetric laminate is defined as a laminate possessing a mid-plane of symmetry, FIG. 8. FIGS. 7A and 8 depict one embodiment of a symmetric laminate. In FIGS. 7A and 8 ply 60 is a mirror image of ply 22. In other words, the individual layers 20, 46, and 54 of ply 20 are mirror images of layers 68, 66, and 64, respectively, of ply 60. Such a laminate is referred to as [0°/±60°/±60°/0°] or $[0/\pm 60]_S$, the subscript S denoting symmetric.

By way of example, each layer, such as ply 20, can have a thickness of about 3.0 mils such that the entire reflector structure 10 of FIG. 1 has a lamination thickness of about 18.0 mils. This laminated structure comprising six layers of unidirectional graphite fiber reinforced epoxy comprises the entire sheet structure forming the reflector structure 10. No additional adhesives are employed in the lamination other than the epoxy resins forming the prepreg material.

Figure 7B:
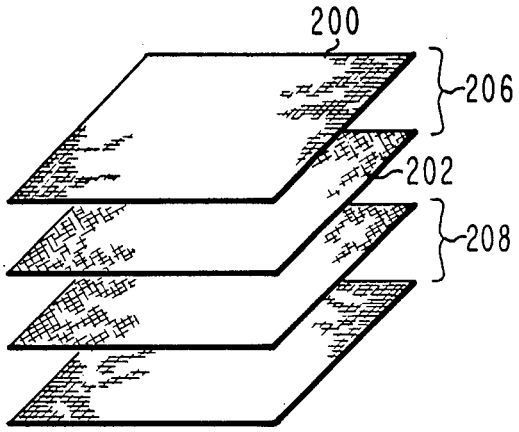

In other embodiments, it is known that quasi-isotropic properties can be obtained with unidirectional fibers having orientations other than the [0°/±60°] described below. Also woven fabrics can be used in the alternative. GFRE woven fabrics have their fibers oriented at a 0° orientation and at 90° relative to the 0° orientation. Two layers 200, 202, FIG. 7B, of woven fabrics, one layer 200, with its fibers oriented 45° relative to the orientations of the corresponding fibers of the other layer 202, form one ply 206. A second mirror image ply 208 having a plane of symmetry at the interface between the two plies 206, 208 is laminated to the first ply 206. In this case a minimum structure comprises four layers of woven carbon fiber reinforced epoxy fabrics. Other relative orientation angles among the different layers may be used to obtain the desired quasi-isotropic properties.

The laminated sheet material forming the reflector 10 has quasi-isotropic properties with respect to its coefficient of thermal expansion (CTE), modulus properties, and stress due to moisture evaporation. With respect to the latter stress, as the reflector structure enters the vacuum of space, the moisture in the structure evaporates. The act of the moisture exiting from the material produces a permanent load on the reflector structure. This permanent load produces a permanent deformation. It is required that the reflector structure distort within acceptable limits as a result of this moisture load. For this purpose the CME (coefficient of moisture expansion which relates to the problem of evaporation of moisture) is as close to zero as possible. Therefore, the choice of material that absorbs moisture or distorts due to the evaporation of moisture is an important factor for the reflector structure.

With respect to the coefficient of thermal expansion, it is required that the reflector structure distort a minimum value as the structure is exposed to full sun or full shade during its orbit about the earth. In this regard, the CTE is made as close to zero as possible.

Because reflector structure 10 is required in the present embodiment to reflect electromagnetic radiation at a very high frequency range, for example, in the K-band, the reflector concave surface 71, FIG. 1, is coated with a vacuum deposited layer of titanium having a thickness of about 100 Å coated with aluminum having a thickness of about 5,000 Å. The titanium layer enhances the adhesion between the aluminum and the GFRE substrate. The metallic coatings also tend to seal the moisture in the structure and prevent moisture from entering into the structure. The aluminum increases the RF reflectance of the surface 71 of reflector 10. The aluminum is further protected by a thin coating of silica ($SiO_2$) which protects the aluminum coating from oxidation. Because the layer of aluminum and silica are relatively thin, their effects on the thermal and strength properties of the reflector 10 are negligible.

Figure 4:
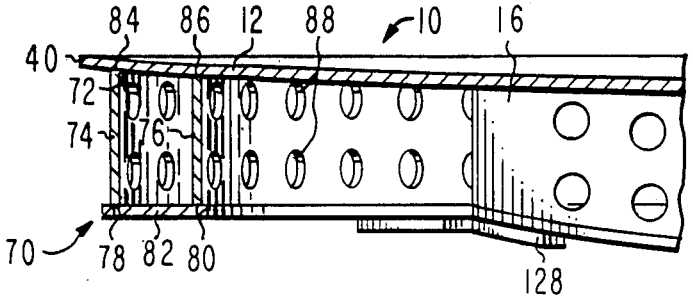
FIG. 4 is a partial elevation sectional view through the structure of FIG. 2 taken along lines 4—4.
Figure 5:
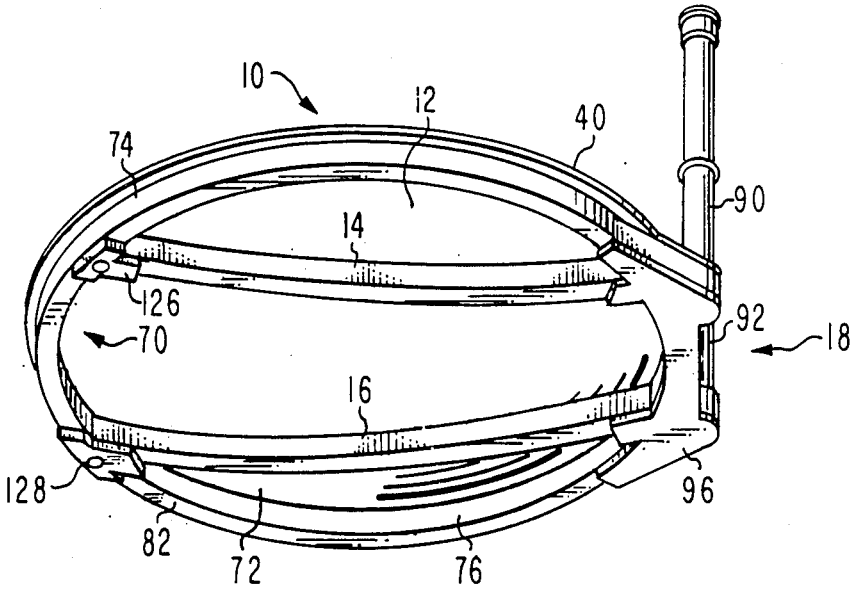
FIG. 5 is a perspective view of the bottom surface of the reflector of FIG. 1 illustrating the rib structure.

The annular stiffening rib 70, FIGS. 1, 2, and 5, is bonded to the reflector sheet 12 at rear surface 72 with an epoxy adhesive to provide additional stiffness to the reflector. In FIG. 4 the stiffener rib 70 is a U-shaped in section ring-like member having an outer circular cylindrical side wall 74 concentric with an inner circular cylindrical side wall 76 and a planar ring-like base wall 82. Side walls 74 and 76 and base wall 82 each comprise two plies of graphite epoxy reinforced fibers of like construction as the plies of reflector sheet 12 and as illustrated in FIGS. 6, 7, and 8. The walls 74 and 76 are bonded with an epoxy adhesive, respectively, at edges 78 and 80 to the planar ring-like base wall 82.

The edges of side walls 74, 76 at 84 and 86, respectively, are bonded with an epoxy adhesive to the rear surface 72 of reflector sheet 12. The outer wall 74 of rib 70 is adjacent the edge of the periphery 40 of the reflector sheet 12. It may be flush with the edge or spaced slightly in from the edge as shown in FIG. 4. The rib 70 also includes a plurality of uniformly spaced identical holes 88 in walls 74 and 76. The holes 88 reduce the amount of material in the rib, i.e., its weight, without reducing its effective strength. These holes are not shown in FIG. 5. The rib 70 strengthens the reflector 10 to prevent distortion when any stresses induced by a force is applied centrally of the reflector sheet 12. These stresses might tend to collapse or spread apart the peripheral edge of the reflector.

The boom structure 18, FIGS. 1, 2, 10, and 11, comprises two circular cylindrical supporting tubes 90 and 92. Tubes 90 and 92 each comprise multiple layers of unidirectional graphite fibers reinforced epoxy. Tubes 90 and 92 are formed by tape or filament winding the individual layers onto a mandrel. The individual layers are oriented such as to provide maximum axial stiffness, minimum axial coefficient of thermal expansion and adequate torsional strength and modulus. In one embodiment, the tubes 90 and 92 comprise ten plies, each ply consisting of two layers of unidirectional graphite fiber reinforced epoxy (GFRE) oriented at $+10°$ and $-10°$, respectively, with respect to the reference axial direction of the tubes 90 and 92. The resulting tube wall thickness in this embodiment is about 60 mils. The tubes may be approximately two inches in diameter. Tubes 90 and 92 are supported at the reflector 10 by truss structure 94.

Figure 11:
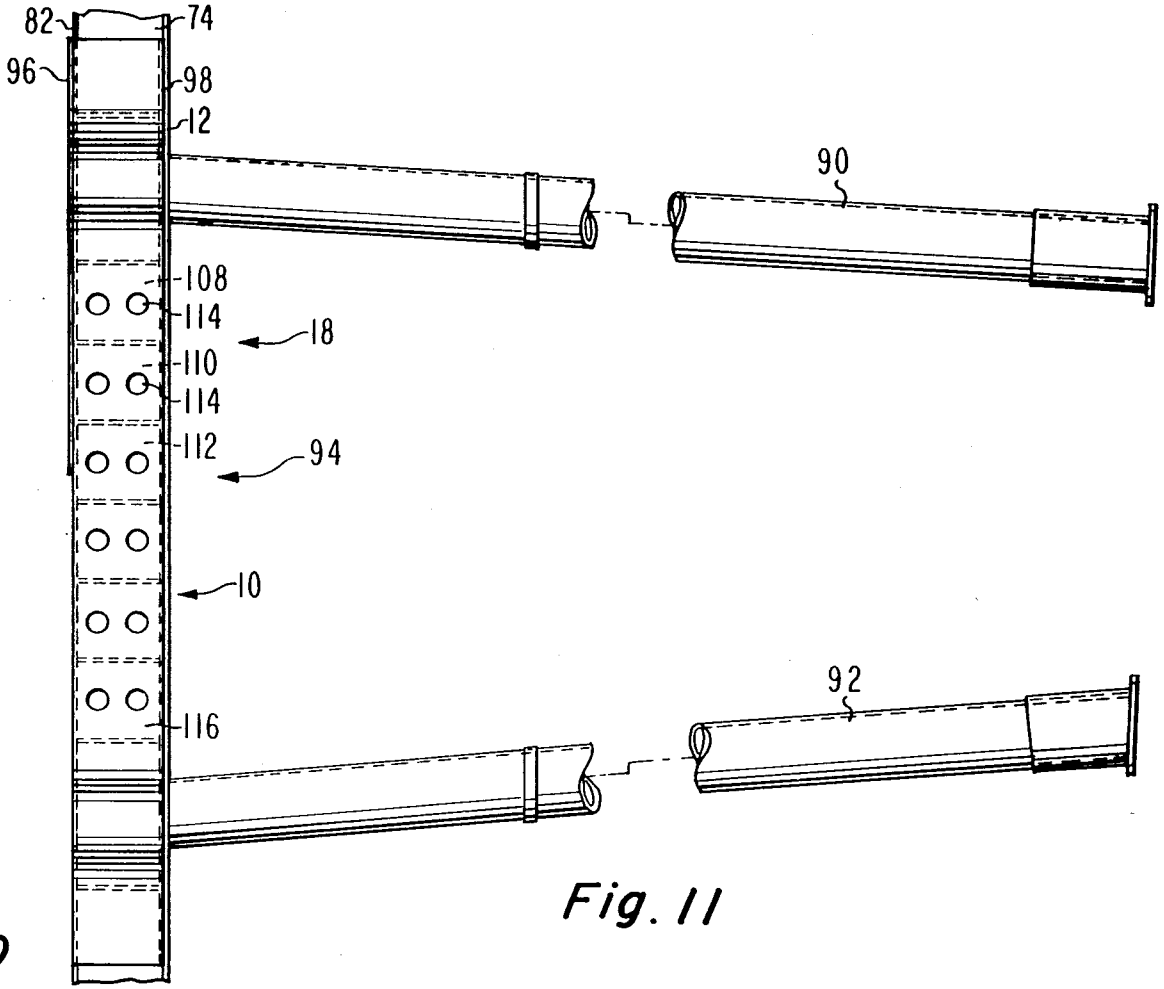
FIG. 11 is an elevation view illustrating the boom structure.
Figure 10:
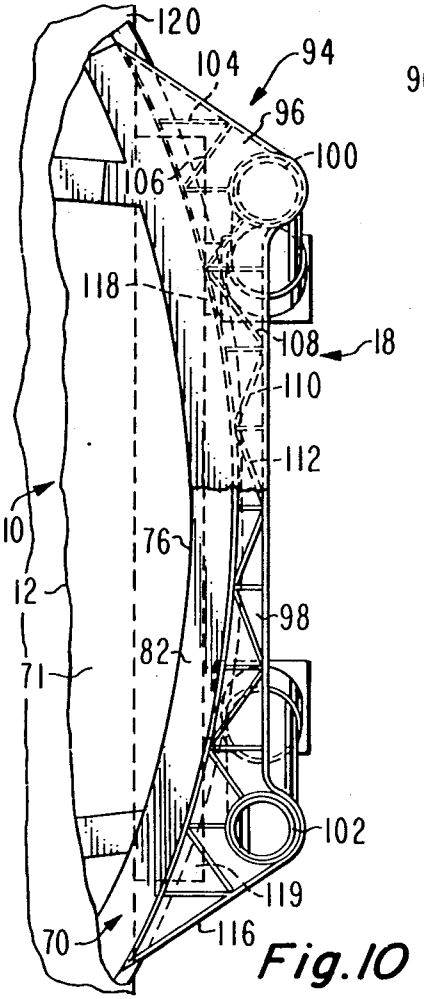
FIG. 10 is a partial sectional fragmented plan view of a portion of the structure of FIG. 1 through the supporting boom area.

In FIGS. 10 and 11 the truss structure 94 comprises upper and lower sheets 96 and 98, respectively. The sheets 96 and 98 are curved to follow the reflector sheet 12 and comprise two plies of graphite fibers reinforced epoxy identical to the plies 22 and 60. Sheet 98, in this case, is an extension of the reflector sheet 12. Sheet 96 is bonded to the outer surface of curved base wall 82 of rib 70. Two circular cylinders 100, 102 of two plies each of GFRE fibers identical to the plies 22 and 60 are bonded between the sheets 96 and 98. The cylinders 100 and 102 are sized to receive the tubes 90 and 92 in close fitting spaced relation. A plurality of planar sheets 104, 106, 108, and so forth, of two plies of GFRE fibers identical to the plies 22 and 60 are bonded in a truss-like arrangement between the sheets 96 and 98 to form the truss structure 94. The trusses formed by sheets 104, 106, 108, and so forth are enclosed by and bonded to outer wall 116 comprising two plies of GFRE fibers identical to the plies 22 and 60. Wall 116 has holes 114 to lighten the structure. The truss elements may be assembled with adhesives after curing of the individual elements.

The tubes 90 and 92 are bonded in and to the cylinders 100 and 102. The other extended ends of the tubes 90, 92 are secured to the spacecraft platform 119 via hinges 118. In this embodiment the tubes 90, 92 are secured to hinges 118 (shown in phantom in FIG. 1) attached to the spacecraft platform 119 so that the reflector 10 may be stowed in one orientation during launch of the spacecraft, FIG. 10, and deployed to its operating position, FIG. 1, after reaching its operating orbit.

To secure the reflector structure 10 in a stowed position tie-down points are located at 122, 124, FIG. 2 and on tubes 90, 92. Stiffening ribs 14 and 16 increase the strength of the reflector structure. The ribs 14 and 16 are bonded to the rear surface 72 of the reflector sheet 12. The ribs 14 and 16 are identical in section and material as rib 70. However, ribs 14 and 16 are parabolic (appear linear in the plan projection of FIG. 2). Rib 16 is aligned with tube 92 and fitting 124 and rib 14 is aligned with tube 90 and fitting 122. The joints between the ribs 14, 16, and 70 are covered with unidirectional GFRE multiple ply caps of plane sheet material such as a cap 126 over ribs 70 and 14, cap 128 over ribs 70 and 16, and sheet 96 of the rib structure 94 which caps the ribs 14, 16, and 70 adjacent the truss structure 94.

By making the reflector sheet 12 a solid structure, RF reflection losses are minimized. By constructing the reflector and rib structures of quasi-isotropic laminates having a CTE close to zero, thermal distortion is also minimized. The reflector design described results in a structure with the following characteristics. The reflector and the support ribs are quasi-isotropic and exhibit very nearly zero coefficient of thermal expansion. The reflector is symmetric about its mid-plane. The reflector design uses a minimum of high coefficient of thermal expansion adhesives to secure the ribs to the reflector sheet and in the truss structure and no honeycomb materials. The temperature gradients through the thickness of the reflector is minimized due to its thinness (about 0.018 inch). All these lead to very nearly zero thermal distortions of the reflector in the operating space environments and hence result in improved performance. Because all of the sheet materials, as laminated, are relatively thin and the materials are lightweight, the composite structure is relatively lighter than other structures utilizing cellular cores. The aluminum coating, while not necessary for C-band frequencies, minimizes losses for K-band frequencies.

The layers of reflector 10 are assembled by laying the layers, one at a time, over a preformed mold, the assembly is then cured at an elevated temperature and pressure using conventional curing processes. The ribs and other structures are also cured and formed with conventional processes. Adhesives may be used to bond the ribs and truss structure to the reflector.

What is claimed is:

1. An electromagnetic radiation reflector structure comprising:

a sheet of laminated material shaped to form an electromagnetic radiation reflector, said sheet being a section of a surface of revolution; and a peripheral stiffening rib of laminated material attached at a surface of and extending about the periphery of said sheet;

said sheet and rib each comprising a laminated material including a plurality of plies where each ply includes a plurality of layers of graphite fiber reinforced epoxy (GFRE), the fibers in at least two adjacent layers being oriented relative to each other to form a quasi-isotropic ply, said quasi-isotropic plies being combined to have a plane of symmetry within said laminated sheet and rib, each layer of said sheet comprising a plurality of tapes of said GFRE fibers, said tapes each having a pair of elongated edges parallel to the fibers thereof, said tapes abutting said edges to form a continuous solid coplanar sheet, said tapes each having a transverse dimension relatively small compared to its length, the fibers in each layer being substantially coplanar and of substantially uniform spacing.

2. The structure of claim 1 wherein said sheet is circular and said peripheral stiffening rib is annular.

3. The structure of claim 2 further including a pair of spaced elongated stiffening ribs extending transversely across and adherently secured to said laminated sheet surface and to said annular stiffening rib, said pair of ribs being of the same construction as said annular stiffening rib.

4. The structure of claim 2 wherein said sheet is concave on one electromagnetic radiation reflecting surface with a rear surface opposite said one reflecting surface being convex, said stiffening rib being secured to said rear surface.

5. The structure of claim 2 wherein said annular stiffening rib comprises a hollow member having a U-shaped transverse cross-section including two side walls and a base wall, said base wall being secured to an edge of each of the two side walls, the other edge of the two side walls being secured to said sheet, said walls each comprising a plurality of said quasi-isotropic plies.

6. The structure of claim 1 wherein said peripheral stiffening rib comprises first and second side walls each comprising a plurality of plies of said tapes, and a base wall attached to an edge of each said side walls and comprising a plurality of plies of said tapes.

7. The structure of claim 1 wherein each said plies include at least three adjacent layers wherein the orientation of said three adjacent layers have the geometry of [0°/±60°] wherein each degree refers to the relative orientation angle of the fibers of the different layers.

8. The structure of claim 1 wherein a surface of said reflector includes a aluminum coating over the radiation reflecting surface, said aluminum coating being coated with a layer of silica ($SiO_2$).

9. The structure of claim 1 further including an antenna boom structure for attaching said sheet in spaced relation to a support and means secured to said peripheral rib and said sheet for securing said boom structure to said sheet.

10. The structure of claim 1 wherein said sheet is a section of a parabola and has a generally circular periphery, said peripheral stiffening rib is circular comprising two concentric circular cylindrical side walls and a base wall comprising a planar ring attached to an edge of each said side walls.

11. An electromagnetic radiation reflector structure comprising:

a parabolic sheet of laminated material having a circular periphery; and an annular stiffening rib attached to said material adjacent said periphery;

said sheet material comprising a plurality of adherently secured like quasi-isotropic plies of graphite fiber reinforced epoxy (GFRE) fibers, each ply comprising a plurality of adherently secured layers of said GFRE fibers, a first layer of each ply comprising a plurality of unidirectional GFRE fibers having a reference orientation, second and third layers of each ply comprising a plurality of unidirectional GFRE fibers having respective first and second mirror image orientations relative to and non-parallel to said reference orientation;

each layer comprising a plurality of tapes of said GFRE fibers, said tapes each having a pair of elongated edges parallel to the fibers thereof, said tapes abutting at said edges to form a continuous coplanar sheet, said tapes each having a transverse dimension relatively small compared to its length the fibers in each layer being substantially coplanar and of substantially uniform spacing;

said stiffening rib comprising a plurality of quasi-isotropic plies formed into a stiffening element secured to a surface of said sheet material.

* * * * *